US005796353A

United States Patent [19]

Whitehead

[11] Patent Number: 5,796,353

[45] Date of Patent: Aug. 18, 1998

[54] FAULT MONITORING EVENT DETECTION DEVICE

[75] Inventor: Matthew Whitehead, Sheffield, United Kingdom

[73] Assignee: Pyronix Limited, South Yorkshire, United Kingdom

[21] Appl. No.: 727,436

[22] PCT Filed: Apr. 11, 1995

[86] PCT No.: PCT/EP95/01331

§ 371 Date: Mar. 13, 1997

§ 102(e) Date: Mar. 13, 1997

[87] PCT Pub. No.: WO95/28692

PCT Pub. Date: Oct. 26, 1995

[30] Foreign Application Priority Data

Apr. 14, 1994 [GB] United Kingdom ..... 9407426

[51] Int. Cl.[6] ..... G08C 19/16

[52] U.S. Cl. ..... 340/870.01; 340/870.09; 340/870.16; 340/825.16; 340/567

[58] Field of Search ..... 340/870.01, 870.09, 340/552, 561, 567, 600, 825.16, 870.16

[56] References Cited

U.S. PATENT DOCUMENTS 4,660,024 4/1987 McMaster ..... 340/522
5,216,410 6/1993 Pildner et al. ..... 340/509

FOREIGN PATENT DOCUMENTS 0 259 015 A3 8/1987 European Pat. Off. ..... G08B 29/00

*Primary Examiner*—Michael Horabik
*Assistant Examiner*—Andrew Hill
*Attorney, Agent, or Firm*—Sheldon & Mak

[57] ABSTRACT

A combined technology event detection device for detection of an event such as movement and/or body temperature, such as an intrusion detection device. The event detection device includes: a passive infrared (PIR) sensor to generate a first output signal in response to detection of an event; a microwave sensor to generate a second output signal in response to detection of an event; a logic device to receive the first and second output signals, which activates an alarm in response thereto; and a fault monitoring system. The fault monitoring system includes: a first counter to store the number of first output signals received from the PIR sensor; a second counter to store the number of second output signals received from the microwave sensor; a signal detector to detect an output signal from either the PIR sensor or the microwave sensor, increment the counter associated with the sensor generating the output signal in response thereto, and re-set the counter not associated with the sensor generating the output signal to a base level; and a logic device which generates an output signal indicative of a fault condition in the event detection device when the number of output signals stored in a counter exceeds a predetermined threshold.

15 Claims, 3 Drawing Sheets

FAULT MONITORING EVENT DETECTION DEVICE

FIELD OF THE INVENTION

This invention relates to event detection devices and more particularly to a combined technology event detection device having an improved fault monitoring system.

BACKGROUND ART

Combined technology event detection devices, including, for example, passive infrared sensors, Doppler shift microwave sensors, acoustic detectors and vibration detectors are known in the art. Typically they are used to detect unauthorised entry or intrusion into a protected space. Examples of such devices including specifically a combination of a photoelectric sensor and a microwave sensor are shown in U.S. Pat. Nos. 3,725,888 and 4,401,976, the entire disclosures of which are incorporated herein by reference.

In a typical combination, the outputs of two independent sensing means, responding to different physical stimuli, are supplied to an AND gate, and if both sensing means register an event within a specified period of time, then an alarm is triggered. In this manner the incidence of false alarms occurring when only a single sensing means is used can be greatly reduced.

A problem with combined technology event detection devices is that both sensing means need to be operating, properly in order for a true event to be detected. If one sensing means is disabled, either due to an electronic failure, sabotage, or faulty installation, and does not detect the event, then an alarm condition will not be triggered. Combined technology event detection devices thus need to be provided with a fault monitoring system. Examples of such monitoring systems are disclosed in U.S. Pat. Nos. 5,216,410 and 4,660,024, the entire disclosures of which are incorporated herein by reference.

In European Patent No. 259015, the entire disclosure of which is incorporated herein by reference, there is described an intrusion detection apparatus having dual sensing means which comprises first and second sensing means, logic means for receiving output signals from the first and second sensing means and for generating an alarm in response thereto, first and second means for storing the number of output signals received respectively from the first and second sensing means, and logic means for comparing the number of first output signals from the first storing means and the number of second output signals from the second storing means and generating an output signal indicative of fault in the apparatus, in response to said comparison.

A drawback to this prior art system is that, unless both sensing means are equally sensitive, there will inevitably be a difference between the number of output signals generated by the first and second sensing means. Since these output signals are counted, stored and compared, it follows that there will Inevitably come a time when the comparison indicates a fault condition even when no fault has occurred, whatever comparison ratio is chosen.

SUMMARY OF THE INVENTION

The invention provides an improved fault detection system for a combined technology event detection device in which a counter associated with a sending means which has become active is incremented and all other counters associated with all other sensing means are reset to a base level. A fault condition is Indicated when any one counter reaches a pre-sat threshold limit level.

Thus, according to the invention, there Is provided a combined technology event detection device which comprises a first sensing means for generating a first output signal in response to the detection of an event, a second sensing means for generating a second output signal in response to the detection of an event, logic means for receiving the first and second output signals and for generating an alarm in response thereto, and a fault monitoring system comprising:

a first means for storing the number of first output signals received from the first sensing means;

a second means for storing the number of second output signals received from the second sensing means: and means for detecting an output signal from either the first or the second sensing means and for incrementing the storing means associated with the sensing means generating the output signal in response thereto, means for re-setting the storing means not associated with the sensing means generating the output signal to a base level; and means for generating an output signal indicative of a fault condition in the device when the number of output signals stored in either storing means exceeds a predetermined threshold level.

The combined technology event detection device may be of the type used for example to detect movement and/or body temperature, and may be, for example, an intrusion detection device. Other uses of the device are, however, also possible. In a preferred embodiment the combined technology event detection device comprises a passive infrared sensor and a Doppler shift microwave sensor, for example, of the type sold by Pyronix Limited under the trade mark Equinox. More than two sensing means may be used where necessary or desired, in which case the logic means may generate an alarm in response to a summation of the output signals received from two or more of the sensing means.

The logic means may be included within one or more microprocessors which can interrogate the sensing means for activity.

The first and second storing may be electronic counters, which can store the desired information in physical or electronic form. Preferably, these are also included in one or more microprocessors.

BRIEF DESCRIPTION OF DRAWINGS

An embodiment of a combined technology event detection device according to the invention will now be more particularly described with reference to the accompanying Drawings in which.

DETAILED DESCRIPTION OF THE DRAWINGS

Figure 1:
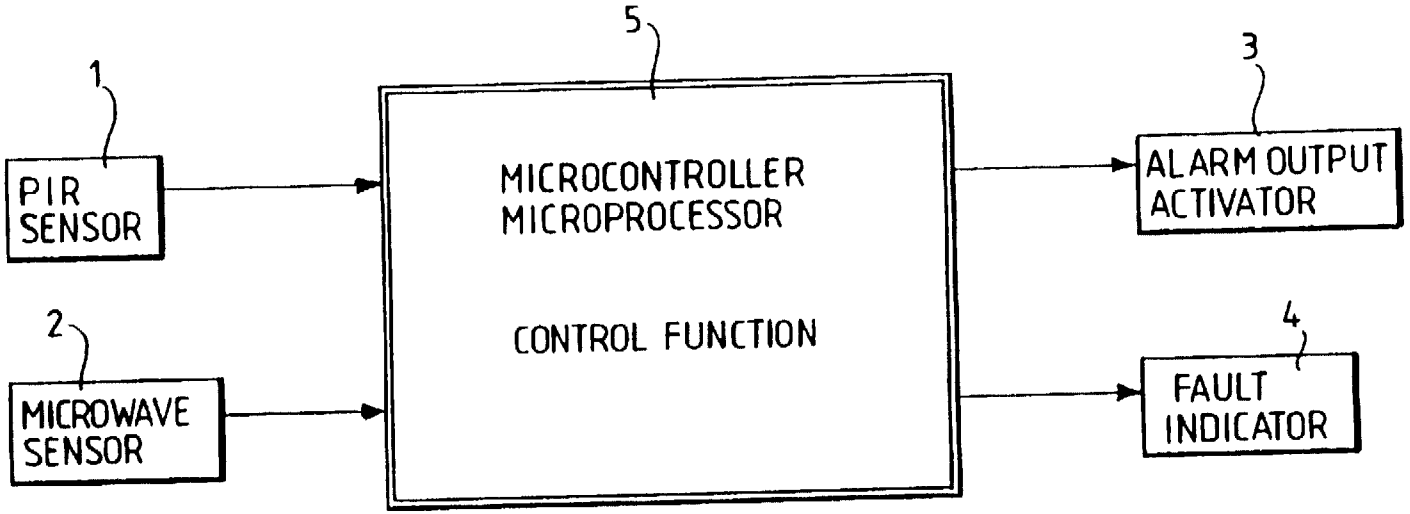
FIG. 1 shows a schematic block diagram of a combined technology event detection device according to the invention.

Referring now to FIG. 1, the detection device comprises a passive infrared sensor 1 and a microwave sensor 2 which are connected to a microcontroller/microprocessor control function 5. Outputs from the microcontroller 5 are connected to an alarm output activator 3 and a fault indicator 4.

Figure 2:
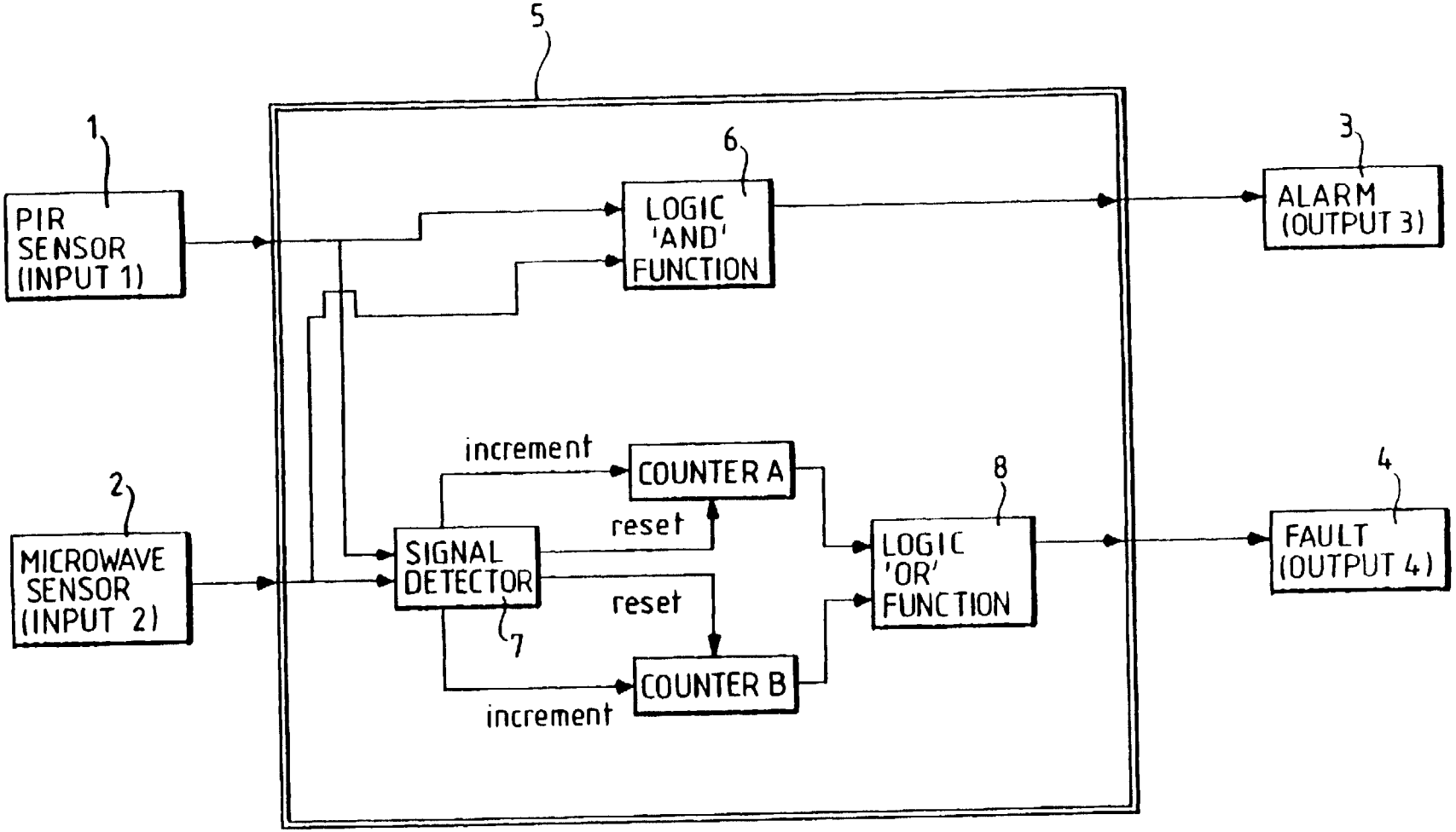
FIG. 2 shows a functional diagram of the microcontroller of FIG. 1.

Referring to FIG. 2, which is a functional diagram of the microcontroller of FIG. 1, it can be seen that the inputs from the passive infrared sensor and the microwave sensor are connected to a logic "and" function 6 whose output is connected to the alarm output activator 3.

The outputs from the passive infrared sensor 1 and the microwave sensor 2 are also connected to a signal detector 7 which in turn is connected to counters A and B. The signal detector can increment counters A and B in response respectively to signals from the passive infrared sensor 1 and the microwave sensor 2 and can also reset the counters to zero. The signal detector operates in such a fashion that if it applies an increment to counter A it will automatically reset counter B to zero and vice versa.

Outputs from counters A and B are led to a logic "or" function B which in turn is connected to the fault indicator 4.

The detection device is shown with two sensing means each having an associated counter, but of course if more than two sensing means and more than two counters are used, then the signal detector automatically resets all counters other than the incremented counter to zero.

The counters A and B are set to give an output when a pre-determined threshold level, for example one million, is reached. When the number of input signals counted by either counter A or counter B exceeds the threshold level an output signal indicating a fault condition is generated. The output of the fault indicator may be connected to a sounder, a visual display, or a telecommunications device.

Figure 3:
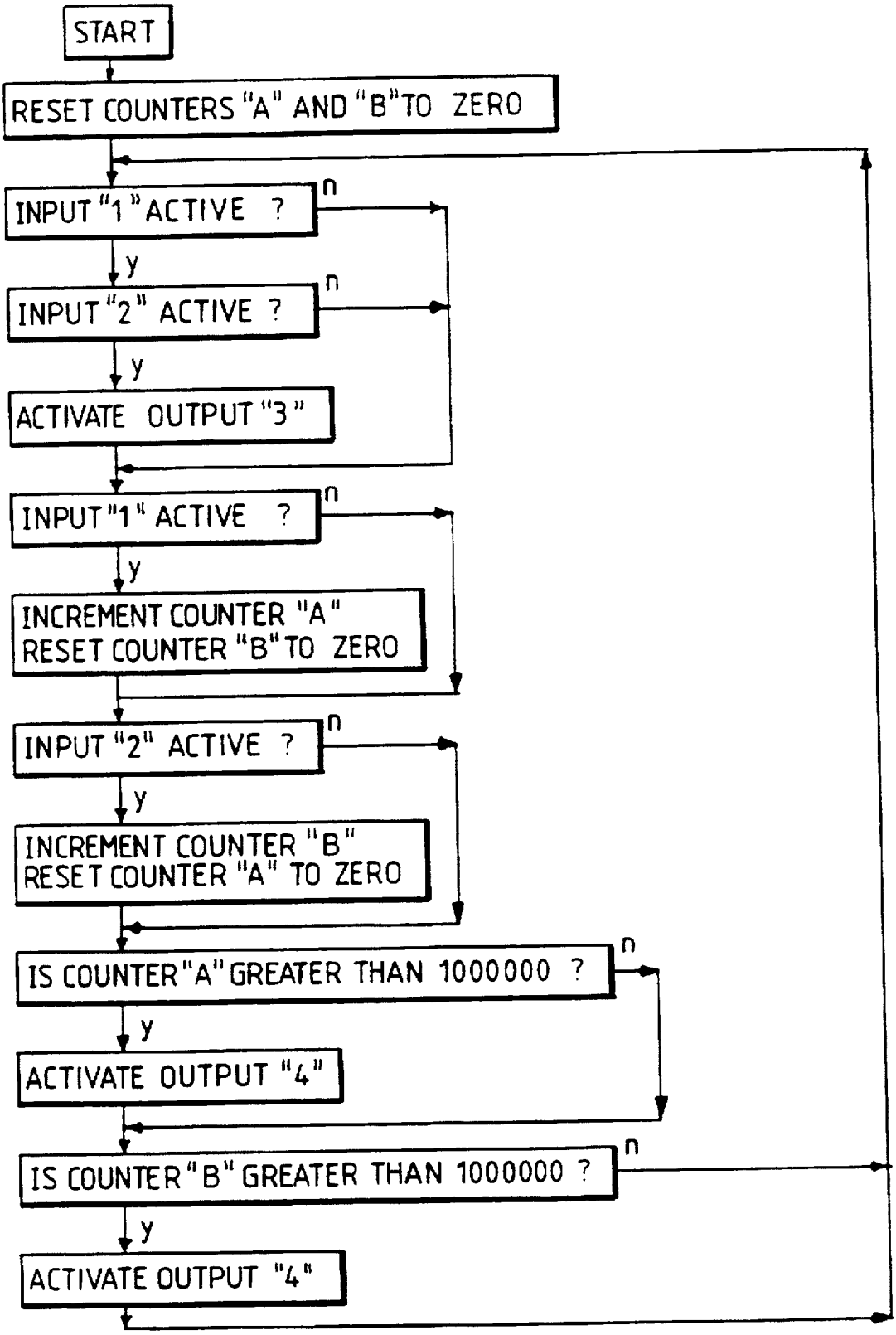
FIG. 3 shown a fault monitoring algorithm for the microcontroller of FIGS. 1 and 2.

The sequence of operations of the fault monitoring system is illustrated in the fault monitoring microcontroller algorithm of FIG. 3.

On start-up the signal detector automatically resets counters A and B to zero. The microcontroller then interrogates the passive infrared sensor 1 and the microwave sensor 2 and if activity is detected the appropriate counter is incremented. At the same time the counter or counters not associated with an active sensor are reset to zero. In this way, unless both sensors are registering activity at the same time, at least one of the counters A and B is always set at zero. If one of the sensors is inactive for a long period, its associated counter will remain at zero whilst the number of signals recorded on the counter associated with the active sensor will rise incrementally.

Finally a point is reached at which the counter associated with the still active sensor arrives at the pre-set threshold limit level. At this point the active counter sends a signal to the logic "or" function which in turn sends a signal to the fault indicator 4 indicating a fault condition.

In the device illustrated, the total programme execution time can be, for example, approximately 500 microseconds, giving a cycle frequency of 2 kHz.

It will be appreciated that the circuitry associated with the fault monitoring system can operate completely independently of the alarm system, which is only triggered it both sensing means are active at the sane time and for a significant period.

The fault monitoring system of the invention can provide an output indicating a fault condition whenever one of the sensing means is falsely indicating an alarm condition or whenever one of the sensing means undergoes an unusually long period of inactivity.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings), and/or all of the steps or any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). This invention extends to any novel one, or any novel combination, of thee features disclosed in this specification (including any accompanying claims, abstract and drawings), or to any novel one, or any novel combination, of the steps of any method or process so disclosed.

I claim:

1. A combined technology event detection device which comprises:

a first sensing means for generating a first output signal in response to an event;

a second sensing means for generating a second output signal in response to an event;

logic means for receiving the first and second output signals and for generating an alarm in response thereto; and a fault monitoring system comprising:

a first means for storing a number of first output signals received from the first sensing means, a second means for storing a number of second output signals received from the second sensing means, means for detecting an output signal from either the first or the second sensing means and for incrementing the number of output signals stored in the storing means associated with the sensing means generating the output signal in response thereto, means for re-setting the number of output signals stored in the storing means not associated with the sensing means generating the output signal to a base level; and means for generating an output signal indicative of a fault condition in the device when the number of output signals stored in a storing means exceeds a pre-determined threshold level.

2. A detection device according to claim 1, which is an intrusion detection device.

3. The detection device as claimed in claim 2, which further comprises a combination of a passive infrared sensor and a microwave sensor.

4. The detection device as claimed in claim 3, which further comprises means for varying the threshold level.

5. A detection device as in any one of claims 1 or 2, which comprises means for varying the threshold level.

6. A detection device as in claim 5, in which the circuitry associated with the fault monitoring system operates independently of the alarm system.

7. A fault monitoring system as in claim 5, further comprising an event detection device.

8. A detection device as in claim 1, in which the fault monitoring system is contained within a microprocessor.

9. A detection device as in claim 1, in which the means for generating an output signal indicative of a fault condition is connected to a sounder, a visual display, or a telecommunications device.

10. A combined event detection device which comprises:

a passive infrared sensor for generating a first output signal in response to an event;

a microwave sensor for generating a second output signal in response to an event;

logic means for receiving the first and second output signals and for generating an alarm in response thereto; and a fault monitoring system comprising:

a first means for storing a number of the first output signals received from the passive infrared sensor, a second means for storing a number of the second output signals received from the microwave sensor, means for detecting an output signal from either the passive infrared sensor or the microwave sensor and for incrementing the number of output signals stored in the storing means associated with the passive infrared sensor or the microwave sensor generating the output signal in response thereto;

means for re-setting the number of output signals stored in the storing means not associated with the passive infrared sensor or the microwave sensor generating the output signal to a base level; and means for generating an output signal indicative of a fault condition in the device when the number of output signals stored in a storing means exceeds a pre-determined threshold level.

11. A detection device as in any one of claims 1, 2, 10 or 8 in which the circuitry associated with the fault monitoring system operates independently of the alarm system.

12. A fault monitoring system as in claim 11, further comprising an event detection device.

13. A fault monitoring system as in any one of claims 1, 2, 10 or 8, further comprising an event detection device.

14. A monitoring method for a combined event detection device, the device comprising:

a first sensing means for generating a first output, signal in response to an event;

a second sensing means for generating a second output signal in response to an event; and logic means for receiving the first and second output signals and for generating an alarm in response thereto, the method comprising:

detecting an output signal from either the first or the second sensing means and incrementing a storing means associated with the sensing means generating the output signal in response thereto;

re-setting the storing means associated with the sensing means which has not generated the output signal to a base level; and generating an output signal indicative of a fault condition in the device when the number of output signals stored in a storing means exceeds a pre-determined threshold level.

15. A combined event detection device which comprises:

a passive infrared sensor for generating a first output signal in response to an event;

a microwave sensor for generating a second output signal in response to an event;

logic means for receiving the first and second output signals and for generating an alarm in response thereto; and a fault monitoring system comprising:

a first means for storing a number of the first output signals received from the passive infrared sensor, a second means for storing a number of the second output signals received from the microwave sensor, means for detecting an output signal from either the passive infrared sensor or the microwave sensor and for incrementing the number of output signals stored in the storing means associated with the passive infrared sensor or the microwave sensor generating the output signal in response thereto;

means for re-setting the number of output signals stored in the storing means not associated with the passive infrared sensor or the microwave sensor generating the output signal to a base level;

means for generating an output signal indicative of a fault condition in the device when the number of output signals stored in a storing means exceeds a pre-determined threshold level; and means for varying the threshold level.

* * * * *